US011763754B2

(12) United States Patent
Kim et al.

(10) Patent No.: US 11,763,754 B2
(45) Date of Patent: Sep. 19, 2023

(54) GRAYSCALE DATA COMPENSATION METHOD AND APPARATUS AND DRIVER CHIP

(71) Applicant: KunShan Go-Visionox Opto-Electronics Co., Ltd., Kunshan (CN)

(72) Inventors: Keun Chul Kim, Kunshan (CN); Huize Li, Kunshan (CN); Jinquan Zhang, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 0 days.

(21) Appl. No.: 17/669,600

(22) Filed: Feb. 11, 2022

(65) Prior Publication Data

US 2022/0165220 A1 May 26, 2022

Related U.S. Application Data

(63) Continuation of application No. PCT/CN2021/070398, filed on Jan. 6, 2021.

(30) Foreign Application Priority Data

Feb. 28, 2020 (CN) ..... 202010128879.3

(51) Int. Cl.
*G09G 3/3275* (2016.01)

(52) U.S. Cl.
CPC ..... *G09G 3/3275* (2013.01); *G09G 2310/027* (2013.01); *G09G 2320/0233* (2013.01); *G09G 2320/0276* (2013.01)

(58) Field of Classification Search
CPC .. G09G 3/3275; G09G 3/3607; G09G 3/3413; G09G 3/3406; G09G 2310/027;
(Continued)

(56) References Cited

U.S. PATENT DOCUMENTS

2011/0222767 A1* 9/2011 Mitsunaga ..... H04N 25/134 382/169
2018/0084157 A1* 3/2018 Uetani ..... H04N 5/202
(Continued)

FOREIGN PATENT DOCUMENTS

CN 102196175 A 9/2011
CN 103310765 A 9/2013
(Continued)

OTHER PUBLICATIONS

International Search Report dated Mar. 30, 2021, in corresponding to International Application No. PCT/CN2021/070398; 5 pages (with English Translation).
(Continued)

*Primary Examiner* — Nitin Patel
*Assistant Examiner* — Amen W Bogale
(74) *Attorney, Agent, or Firm* — Maier & Maier, PLLC

(57) ABSTRACT

A grayscale data compensation method and apparatus and a driver chip. The grayscale data compensation method includes acquiring an input display brightness instruction value; determining a coefficient variation value corresponding to the input display brightness instruction value according to a relationship in magnitude between the input display brightness instruction value and a range boundary instruction value corresponding to a range boundary; and compensating grayscale data according to the coefficient variation value and a reference compensation coefficient pre-stored under a standard brightness instruction value.

14 Claims, 4 Drawing Sheets

(58) Field of Classification Search
CPC ... G09G 2320/0693; G09G 2320/0233; G09G 2320/0276; G09G 2320/0285; G09G 2320/0271; G09G 2320/0673; G09G 2360/16; G09G 5/10; G09G 5/026
See application file for complete search history.

(56) References Cited

U.S. PATENT DOCUMENTS

| | | | | |
|---|---|---|---|---|
| 2021/0125545 | A1* | 4/2021 | Sohn | G09G 3/32 |
| 2023/0069956 | A1* | 3/2023 | Chen | G09G 3/2092 |

FOREIGN PATENT DOCUMENTS

| | | | |
|---|---|---|---|
| CN | 104021759 | A | 9/2014 |
| CN | 107799084 | A | 3/2018 |
| CN | 108877736 | A | 11/2018 |
| CN | 111243512 | A | 6/2020 |
| JP | 2007-189359 | A | 7/2007 |
| KR | 10-2015-0078839 | A | 7/2015 |
| KR | 10-2018-0042568 | A | 4/2018 |

OTHER PUBLICATIONS

The First Office Action for Chinese Application No. 202010128879.3, dated Dec. 2, 2020, 11 pages (with Machine Translation).

* cited by examiner

GRAYSCALE DATA COMPENSATION METHOD AND APPARATUS AND DRIVER CHIP

CROSS REFERENCE TO RELATED APPLICATIONS

The present application is a continuation of International Patent Application No. PCT/CN2021/070398, filed on Jan. 6, 2021, which is based on and claims priority to Chinese Patent Application No. 202010128879.3 filed with the China National Intellectual Property Administration (CNIPA) on Feb. 28, 2020, the disclosures of which are incorporated herein by reference in their entireties.

TECHNICAL FIELD

The present disclosure relates to the field of display technology, for example, a grayscale data compensation method and apparatus and a driver chip.

BACKGROUND

With the development of display technology, an increasingly high requirement is imposed on the quality of image display.

An organic light-emitting display panel includes a plurality of sub-pixels. When the image display is performed, corresponding data is supplied to the plurality of sub-pixels to achieve display in different grayscales. Due to materials, techniques and the like, some products may have the phenomenon of mura. In the related art, an optical compensation (demura) device including a camera is used for compensating for the mura.

However, in the related art, a display panel has the problems of a relatively poor mura compensation effect and relatively poor uniformity after brightness adjustment.

SUMMARY

The present disclosure provides a grayscale data compensation method and apparatus and a driver chip to achieve a good mura compensation effect when brightness adjustment is performed on a display panel, improving display uniformity.

A grayscale data compensation method is provided, which includes steps described below.

An input display brightness instruction value is acquired, where at least two ranges having a range boundary therebetween are provided between a minimum display brightness instruction value and a maximum display brightness instruction value.

A coefficient variation value corresponding to the input display brightness instruction value is determined according to a relationship in magnitude between the input display brightness instruction value and a range boundary instruction value corresponding to a range boundary, where the coefficient variation value is a difference value between a target grayscale compensation coefficient corresponding to the input display brightness instruction value and a reference compensation coefficient under a standard brightness instruction value.

Grayscale data is compensated according to the coefficient variation value and the reference compensation coefficient pre-stored under the standard brightness instruction value.

A grayscale data compensation apparatus is further provided, which includes a processor and a storage medium, where the storage medium is configured to store instructions, and the processor is configured to, when executing the instructions, perform the following.

An input display brightness instruction value is acquired, where at least two ranges having a range boundary therebetween are provided between a minimum display brightness instruction value and a maximum display brightness instruction value.

A coefficient variation value corresponding to the input display brightness instruction value is determined according to a magnitude relationship between the input display brightness instruction value and a range boundary instruction value corresponding to a range boundary, where the coefficient variation value is a difference value between a target grayscale compensation coefficient corresponding to the input display brightness instruction value and a reference compensation coefficient under a standard brightness instruction value.

Grayscale data is compensated according to the coefficient variation value and the reference compensation coefficient pre-stored under the standard brightness instruction value.

A driver chip is further provided, which includes the preceding grayscale data compensation apparatus and a storage medium, where the storage medium includes a first storage space and a second storage space, the first storage space stores coefficient variation values and the second storage space stores a reference compensation coefficient.

According to the grayscale data compensation method and apparatus and the driver chip provided in the present embodiment, the coefficient variation value corresponding to the input display brightness instruction value is determined according to the relationship in magnitude between the input display brightness instruction value and the range boundary instruction value corresponding to the range boundary; and the grayscale data is compensated according to the coefficient variation value and the reference compensation coefficient pre-stored under the standard brightness instruction value. Since the coefficient variation value corresponds to the display brightness instruction value, the grayscale data compensation method provided in the present embodiment can take an effect of a brightness level (corresponding to the display brightness instruction value) on the mura compensation effect into account so that different brightness levels can correspond to grayscale compensation coefficients which are not exactly the same, that is, a grayscale compensation coefficient obtained finally corresponds to the display brightness instruction value, improving the mura compensation effect and the display uniformity.

DETAILED DESCRIPTION

The present disclosure is described below in conjunction with drawings and embodiments.

In the related art, a display panel has the problems of a relatively poor mura compensation effect and relatively poor display uniformity after brightness adjustment. The preceding problems occur for the following reason: mura is compensated for by a camera, first grayscale data is used for compensating for the mura when display brightness corresponding to a maximum grayscale of the display panel is first brightness, and the first grayscale data is still used for compensating for the mura when the display brightness corresponding to the maximum grayscale of the display panel is second brightness. That is, after a user adjusts the brightness corresponding to the maximum grayscale of the display panel (display brightness corresponding to another grayscale changes with the brightness corresponding to the maximum grayscale, that is, the overall brightness of the display panel changes, and the adjustment of the display brightness corresponding to the maximum grayscale may be referred to as the adjustment of a brightness level hereinafter), grayscale data for compensating for the mura remains unchanged. However, since the luminescence efficiency of an organic light-emitting device is related to brightness, that is, the luminescence efficiency of the light-emitting device may be different under different brightness. Therefore, when the mura is compensated for using the same grayscale data at all brightness levels, the compensation effect is relatively poor and thus the display uniformity is relatively poor.

Figure 1:
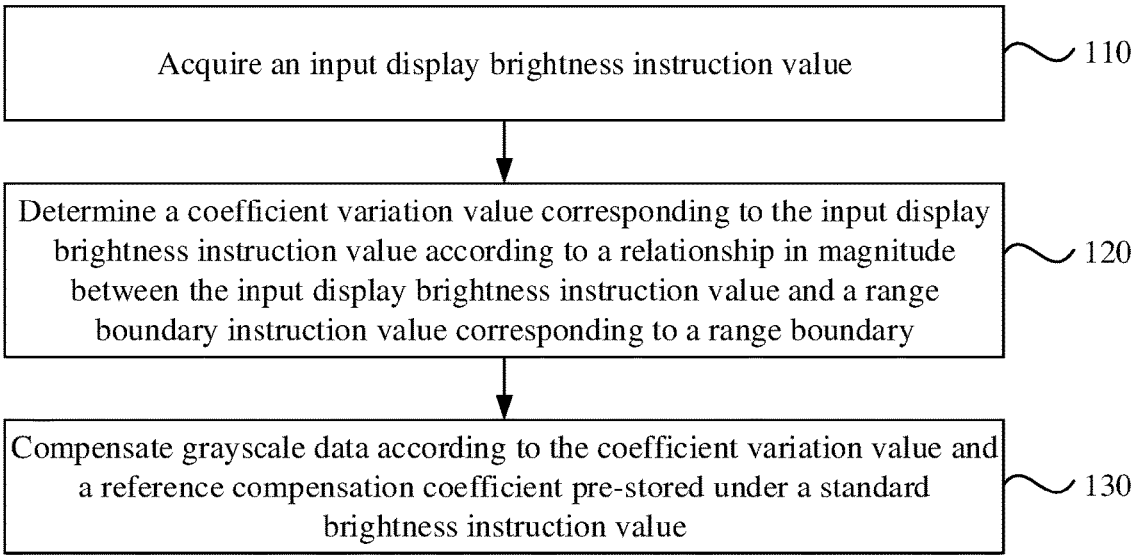
FIG. 1 is a flowchart of a grayscale data compensation method according to an embodiment.

Based on the preceding problems, the present embodiment provides a grayscale data compensation method, and the method is used for performing grayscale data compensation on pixels in an organic light-emitting display panel to alleviate mura. FIG. 1 is a flowchart of a grayscale data compensation method according to an embodiment. Referring to FIG. 1, the grayscale data compensation method includes steps 110 to 130.

In step 110, an input display brightness instruction value (DBV) is acquired, where at least two ranges having a range boundary therebetween are provided between a minimum display brightness instruction value and a maximum display brightness instruction value.

A display device such as a mobile phone or a computer includes a brightness adjustment button. A user adjusts the overall display brightness of the display device by the brightness adjustment button. Each press operation on the brightness adjustment button may correspond to one input display brightness instruction value. Each display brightness instruction value may correspond to respective display brightness of a maximum grayscale in the display panel. Display brightness corresponding to another grayscale changes with the display brightness corresponding to the maximum grayscale in the display panel. In the case where the display brightness corresponding to the maximum grayscale in the display panel increases, the display brightness corresponding to another grayscale also increases. In the case where the display brightness corresponding to the maximum grayscale in the display panel decreases, the display brightness corresponding to another grayscale also decreases. Therefore, it may also be understood as that each input display brightness instruction value may correspond to one brightness level of the display panel. When the display brightness corresponding to the maximum grayscale in the display panel is higher, the brightness level is higher and the overall display brightness of the display panel is higher. When the display brightness corresponding to the maximum grayscale in the display panel is lower, the brightness level is lower and the overall display brightness of the display panel is lower.

Figure 2:
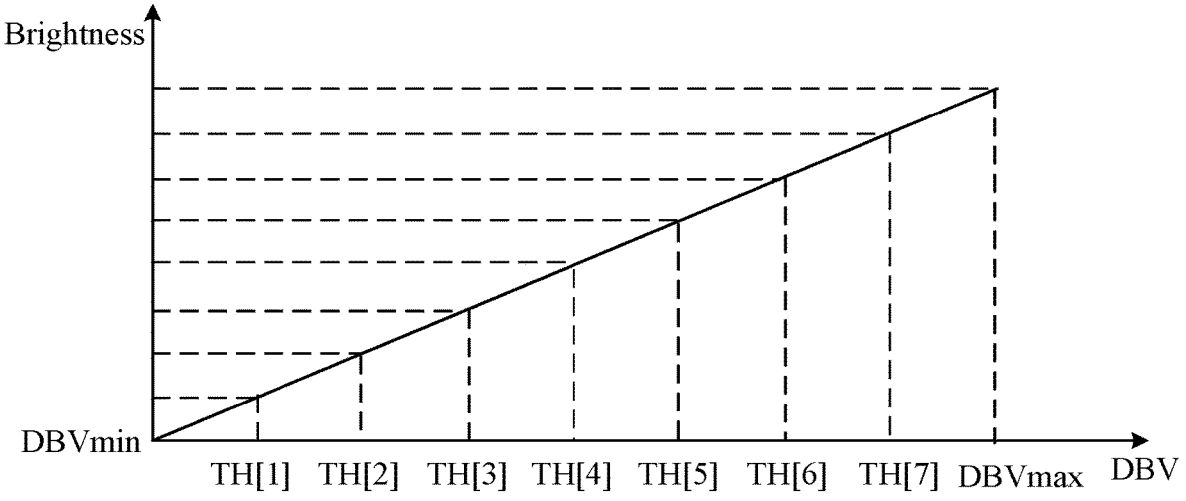
FIG. 2 is a diagram illustrating a relationship between display brightness instruction values and display brightness of a maximum grayscale according to an embodiment.

In step 110, the minimum display brightness instruction value refers to a display brightness instruction value corresponding to minimum display brightness of the maximum grayscale and the maximum display brightness instruction value refers to a display brightness instruction value corresponding to maximum display brightness of the maximum grayscale. In the present embodiment, the at least two ranges having a range boundary therebetween are provided between the minimum display brightness instruction value and the maximum display brightness instruction value. Since each display brightness instruction value corresponds to the respective display brightness of the maximum grayscale, the display brightness corresponding to the maximum grayscale is divided into the at least two ranges, correspondingly. FIG. 2 is a diagram illustrating a relationship between display brightness instruction values and display brightness of a maximum grayscale according to an embodiment, where the abscissa "DBV" represents the display brightness instruction value and the ordinate "Brightness" represents the display brightness corresponding to the maximum grayscale. In FIG. 2, eight ranges exist between the minimum display brightness instruction value $DBV_{min}$ and the maximum display brightness instruction value $DBV_{max}$, where range boundary instruction values corresponding to range boundaries are $DBV_{min}$, TH[1], TH[2], TH[3], TH[4], TH[5], TH[6], TH[7] and $DBV_{max}$, respectively. Correspondingly, the display brightness of the maximum grayscale is also divided into the eight ranges corresponding to the display brightness instruction values, where the range boundaries of the display brightness instruction values correspond to range boundaries of the display brightness of the maximum grayscale.

In step 120, a coefficient variation value corresponding to the input display brightness instruction value is determined according to a relationship in magnitude between the input display brightness instruction value and a range boundary instruction value corresponding to a range boundary.

The coefficient variation value is a difference value between a target grayscale compensation coefficient corresponding to the input display brightness instruction value and a reference compensation coefficient under a standard brightness instruction value.

Before the display panel leaves a factory, demura needs to be performed on the display panel. In this process, under a standard brightness level corresponding to the standard brightness instruction value, compensation data corresponding to a plurality of grayscales are measured and grayscale compensation data obtained under the standard brightness level is stored. When the grayscale compensation data obtained under the standard brightness level is applied to all brightness levels for mura compensation, the mura compensation effect is relatively poor. In this step, the coefficient variation value corresponding to the input display brightness instruction value is determined according to the relationship in magnitude between the input display brightness instruction value and the interval boundary instruction value (for example, in FIG. 2, the interval boundary instruction value is $DBV_{min}$, TH[1], TH[2], TH[3], TH[4], TH[5], TH[6], TH[7] or $DBV_{max}$) corresponding to the interval boundary.

The coefficient variation value is the difference value between the target grayscale compensation coefficient corresponding to the input display brightness instruction value and the reference compensation coefficient under the standard brightness instruction value. For example, the difference value may be a differential or a ratio, which is not limited in the present embodiment. Moreover, the coefficient variation value may be a positive value or a negative value.

The preceding step 120 may include step 121 and step 122.

In step 121, the input display brightness instruction value is compared with the interval boundary instruction value and in the case where the input display brightness instruction value is equal to the interval boundary instruction value, a pre-stored coefficient variation value corresponding to the interval boundary instruction value is determined to be the coefficient variation value corresponding to the input display brightness instruction value.

Table 1 exemplarily illustrates the eight ranges between the minimum display brightness instruction value $DBV_{min}$ and the maximum display brightness instruction value $DBV_{max}$ in FIG. 2, where the interval boundary instruction values corresponding to the interval boundaries are $DBV_{min}$, TH[1], TH[2], TH[3], TH[4], TH[5], TH[6], TH[7] and $DBV_{max}$, respectively and illustrates coefficient variation values corresponding to the plurality of interval boundary instruction values. Since brightness corresponding to $DBV_{min}$ is 0, the mura compensation is not required. Therefore, a coefficient variation value corresponding to $DBV_{min}$ is not included in Table 1.

TABLE 1

| | Interval boundary instruction value | | | | | | | |
|---|---|---|---|---|---|---|---|---|
| | TH[1] | TH[2] | TH[3] | TH[4] | TH[5] | TH[6] | TH[7] | DBVmax |
| Coefficient | Δα[1] | Δα[2] | Δα[3] | Δα[4] | Δα[[5] | 0 | Δα[6] | Δα[7] |
| Variation | Δβ[1] | Δβ[2] | Δβ[3] | Δβ[4] | Δβ[5] | 0 | Δβ[6] | Δβ[7] |
| Value | Δγ[1] | Δγ[2] | Δγ[3] | Δγ[4] | Δγ[5] | 0 | Δγ[6] | Δγ[7] |

In step 122, in the case where the input display brightness instruction value is greater than a first interval boundary instruction value and less than a second interval boundary instruction value, the coefficient variation value corresponding to the input display brightness instruction value is calculated using an interpolation method according to a pre-stored coefficient variation value corresponding to the first interval boundary instruction value and a pre-stored coefficient variation value corresponding to the second interval boundary instruction value.

The first interval boundary instruction value and the second interval boundary instruction value are two interval boundary instruction values of the same interval, respectively.

Since a plurality of display brightness instruction values are included within each interval, when the input display brightness instruction value is not equal to the interval boundary instruction value corresponding to the interval boundary but is greater than the first interval boundary instruction value corresponding to a smaller interval boundary of a range and less than the second interval boundary instruction value corresponding to a larger interval boundary of the same interval, the coefficient variation value corresponding to the input display brightness instruction value may be calculated by the interpolation method, so as to obtain the corresponding coefficient variation value.

When the coefficient variation value is calculated using the interpolation method, a linear interpolation method or a polynomial interpolation method may be used, which is not limited in the present embodiment.

Optionally, in the case where the input display brightness instruction value is greater than the first interval boundary instruction value and less than the second interval boundary instruction value, the coefficient variation value corresponding to the input display brightness instruction value is calculated using the following formula:

$$Coefficientx = \text{Coefficient}\ [n-1]*(\text{Now}\ DBV - TH[k])/(TH[k-1] - TH[k]) + \text{Coefficient}\ [n]*(\text{Now}\ DBV - TH[k-1])/(TH[k] - TH[k-1]).$$

Coefficientx denotes the coefficient variation value corresponding to the input display brightness instruction value, Coefficient[n−1] denotes the coefficient variation value corresponding to the first interval boundary instruction value, Coefficient[n] denotes the coefficient variation value corresponding to the second interval boundary instruction value, Now DBV denotes the input display brightness instruction value, TH[k−1] denotes the first interval boundary instruction value, and TH[k] denotes the second interval boundary instruction value.

Since a certain storage space is required when the coefficient variation value is stored, only the coefficient variation value corresponding to the interval boundary instruction value is stored and a coefficient variation value corresponding to a display brightness instruction value within the interval is calculated by the interpolation method so that a data storage amount can be reduced, saving the hardware cost for storage.

In step 130, grayscale data is compensated according to the coefficient variation value and the reference compensation coefficient pre-stored under the standard brightness instruction value.

After the coefficient variation value corresponding to the input display brightness instruction value is determined, the grayscale data may be compensated according to the coefficient variation value and the reference compensation coefficient pre-stored under the standard brightness instruction value. Exemplarily, grayscale data before demura is x and grayscale data after demura using the grayscale data compensation method provided in the present embodiment is y, where it is assumed that y is a quadratic function of x. Assuming that reference compensation parameters corresponding to the standard brightness instruction value are α, β and γ, referring to FIG. 2 and Table 1, for example, when the input display brightness instruction value is TH[2] and the coefficient variation value represents the differential between the target grayscale compensation coefficient corresponding to the input display brightness instruction value and the reference compensation coefficient under the standard brightness instruction value, the relationship between y and x may be expressed as:

$$y = (\alpha + \Delta\alpha[2])x^2 + (\beta + \Delta\beta[2])x + (\gamma + \Delta\gamma[2]).$$

α+Δα[2], β+Δ[2] and γ+Δγ[2] may be regarded as a final grayscale compensation coefficient corresponding to the display brightness instruction value TH[2].

As can be seen from the preceding formula, the compensated grayscale data is related to not only the reference compensation coefficient under the standard brightness instruction value but also the coefficient variation value corresponding to the display brightness instruction value. Since the coefficient variation value corresponds to the display brightness instruction value, the grayscale data compensation method provided in the present embodiment can take an effect of the brightness level (corresponding to the display brightness instruction value) on the mura compensation effect into account so that different brightness levels can correspond to grayscale compensation coefficients which are not exactly the same, that is, the grayscale compensation coefficient obtained finally corresponds to the brightness level (the display brightness instruction value), improving the mura compensation effect and the display uniformity.

According to the grayscale data compensation method provided in the present embodiment, the coefficient variation value corresponding to the input display brightness instruction value is determined according to the relationship in magnitude between the input display brightness instruction value and the interval boundary instruction value corresponding to the interval boundary; and the grayscale data is compensated according to the coefficient variation value and the reference compensation coefficient pre-stored under the standard brightness instruction value. Since the coefficient variation value corresponds to the display brightness instruction value, the grayscale data compensation method provided in the present embodiment can take the effect of the brightness level (corresponding to the display brightness instruction value) on the mura compensation effect into account so that different brightness levels can correspond to grayscale compensation coefficients which are not exactly the same, that is, the grayscale compensation coefficient obtained finally corresponds to the display brightness instruction value, improving the mura compensation effect and the display uniformity.

Figure 3:
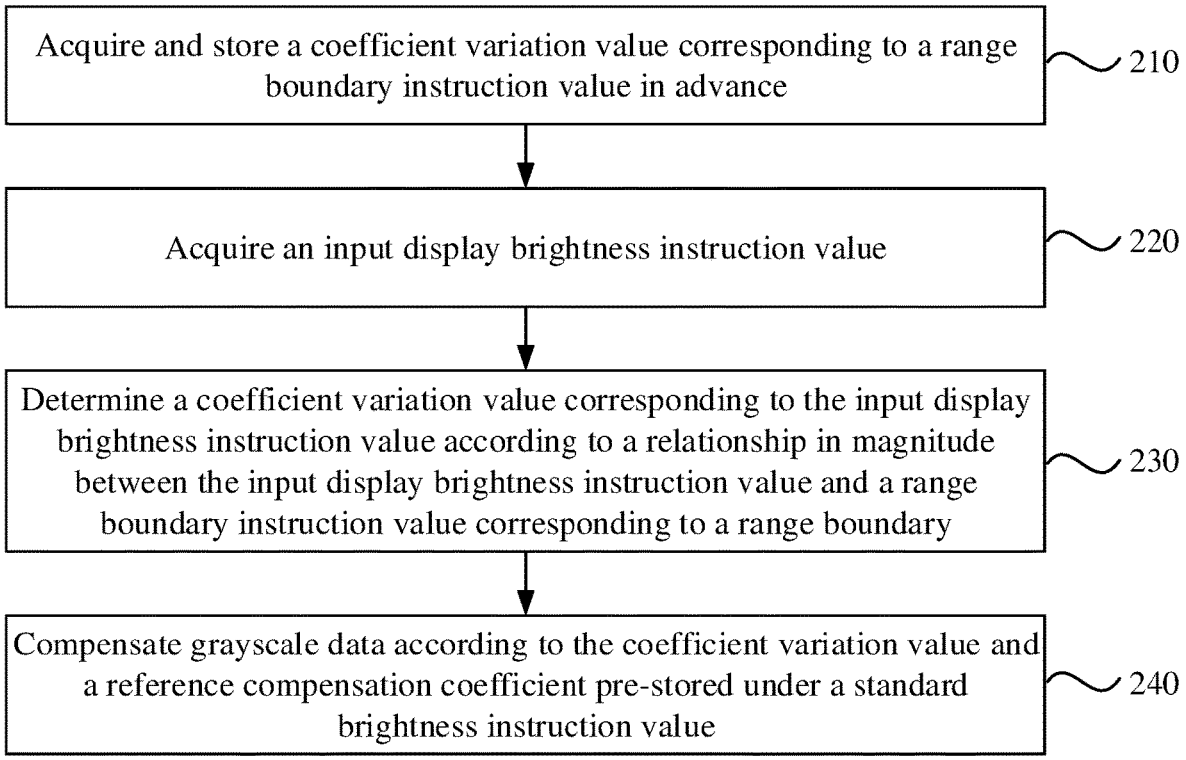
FIG. 3 is a flowchart of another grayscale data compensation method according to an embodiment.

FIG. 3 is a flowchart of another grayscale data compensation method according to an embodiment. Referring to FIG. 3, the grayscale data compensation method includes steps 210 to 240.

In step 210, a coefficient variation value corresponding to a range boundary instruction value is acquired and stored in advance.

After a plurality of interval boundary instruction values are determined, grayscale compensation coefficients under the plurality of interval boundary instruction values may be acquired using a demura device, difference values between grayscale compensation coefficients under a plurality of display brightness instruction values and a reference compensation coefficient under standard brightness are calculated according to the grayscale compensation coefficients under the plurality of display brightness instruction values and the reference compensation coefficient under the standard brightness, and the difference values are stored. The difference values are in a one-to-one correspondence with the plurality of interval boundary instruction values, and the difference values corresponding to the plurality of display brightness instruction values are coefficient variation values corresponding to the plurality of interval boundary instruction values.

A method of acquiring the grayscale compensation coefficients under the plurality of interval boundary instruction values is not limited to the method of acquiring the grayscale compensation coefficients by using the demura device and may include acquiring only a grayscale compensation coefficient under a standard brightness instruction value by using the demura device and calculating and acquiring the grayscale compensation coefficients under the plurality of interval boundary instruction values by using a software algorithm (which may include a formula).

In step 220, an input display brightness instruction value is acquired, where at least two ranges exist between a minimum display brightness instruction value and a maximum display brightness instruction value. The step is the same as step 110 in the preceding embodiment and is not repeated here.

In step 230, a coefficient variation value corresponding to the input display brightness instruction value is determined according to a relationship in magnitude between the input display brightness instruction value and a range boundary instruction value corresponding to a range boundary. The step is the same as step 120 in the preceding embodiment and is not repeated here.

In step 240, grayscale data is compensated according to the coefficient variation value and the reference compensation coefficient pre-stored under the standard brightness instruction value.

The step is the same as step 130 in the preceding embodiment and is not repeated here.

On the basis of the preceding technical solution, optionally, the interval boundary instruction value corresponding to the interval boundary includes the standard brightness instruction value.

Using the case shown in Table 1 as an example, TH[6] among the interval boundary instruction values is the standard brightness instruction value. Since the reference compensation coefficient is demura data measured under the standard brightness instruction value, a coefficient variation value corresponding to the interval boundary instruction value TH[6] is 0. Therefore, when the eight ranges in FIG. 2 exist between the minimum display brightness instruction value and the maximum display brightness instruction value, only 7 sets of coefficient variation values are stored. Accordingly, in the case where n ($n \geq 2$) ranges exist between the minimum display brightness instruction value and the maximum display brightness instruction value, only $(n-1)$ sets of coefficient variation values are stored so that a data storage amount can be reduced.

On the basis of the preceding technical solution, optionally, different grayscales corresponding to the same display brightness instruction value correspond to the same coefficient variation value.

Different grayscales corresponding to the same display brightness instruction value correspond to the same coefficient variation value, that is, for the different grayscales corresponding to the same display brightness instruction value, the grayscale data may be compensated according to the same coefficient variation value and the reference compensation coefficient under the standard brightness instruction value. A certain storage space is required for storing the coefficient variation values. Therefore, the different grayscales corresponding to the same display brightness instruction value are configured with the same coefficient variation value so that the data storage amount of the coefficient variation values can be reduced, which is conducive to reducing the hardware cost for storage.

Figure 4:
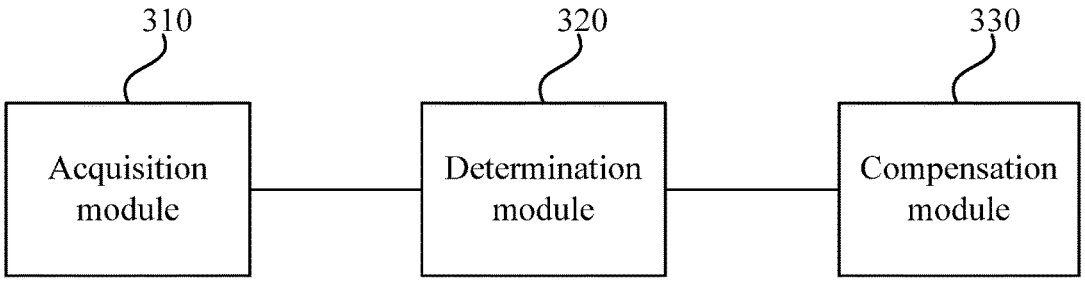
FIG. 4 is a structure diagram of a grayscale data compensation apparatus according to an embodiment.

An embodiment provides a grayscale data compensation apparatus, which may be configured to perform the grayscale data compensation method provided in any one of the preceding embodiments of the present disclosure. FIG. 4 is a structure diagram of a grayscale data compensation apparatus according to an embodiment. Referring to FIG. 4, the grayscale data compensation apparatus includes an acquisition module 310, a determination module 320 and a compensation module 330.

The acquisition module 310 is configured to acquire an input display brightness instruction value, where at least two ranges exist between a minimum display brightness instruction value and a maximum display brightness instruction value.

The determination module 320 is configured to determine a coefficient variation value corresponding to the input display brightness instruction value according to a relationship in magnitude between the input display brightness instruction value and a range boundary instruction value corresponding to a range boundary, where the coefficient variation value is a difference value between a target grayscale compensation coefficient corresponding to the input display brightness instruction value and a reference compensation coefficient under a standard brightness instruction value.

The compensation module 330 is configured to compensate grayscale data according to the coefficient variation value and the reference compensation coefficient pre-stored under the standard brightness instruction value.

On the basis of the preceding technical solution, the determination module 320 includes a comparison unit configured to compare the input display brightness instruction value with the interval boundary instruction value. The comparison unit may be implemented by software or hardware, which is not limited in the present embodiment.

According to the grayscale data compensation apparatus provided in the present embodiment, the coefficient variation value corresponding to the input display brightness instruction value is determined according to the relationship in magnitude between the input display brightness instruction value acquired by the acquisition module and the interval boundary instruction value corresponding to the interval boundary; the coefficient variation value corresponding to the input display brightness instruction value is determined by the determination module according to the relationship in magnitude between the input display brightness instruction value and the interval boundary instruction value corresponding to the interval boundary; and the grayscale data is compensated by the compensation module according to the coefficient variation value and the reference compensation coefficient pre-stored under the standard brightness instruction value. An effect of a brightness level (corresponding to the display brightness instruction value) on a mura compensation effect is taken into account so that different brightness levels can correspond to grayscale compensation coefficients which are not exactly the same, that is, a grayscale compensation coefficient obtained finally corresponds to the brightness level (the display brightness instruction value), improving the mura compensation effect and display uniformity.

Figure 5:
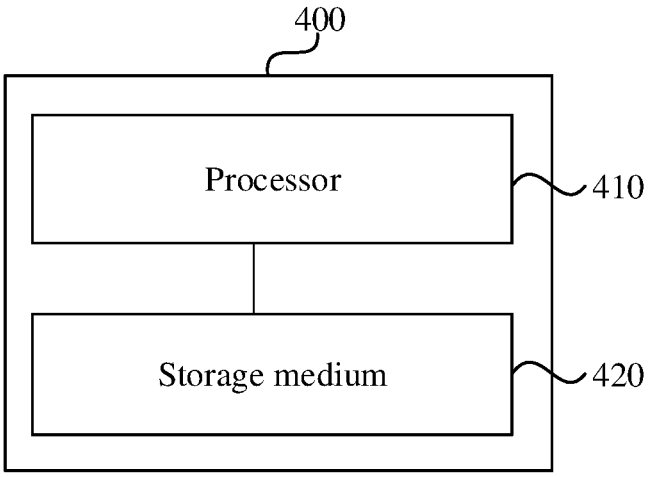
FIG. 5 is a structure diagram of a grayscale data compensation apparatus according to another embodiment.

FIG. 5 is a structure diagram of a grayscale data compensation apparatus according to another embodiment. Referring to FIG. 5, the embodiment provides a grayscale data compensation apparatus 400, which includes a processor 410 and a storage medium 420, where the storage medium 420 is configured to store instructions, and the processor 410 is configured to, when executing the instructions, perform the grayscale data compensation method provided in any one of the preceding embodiments of the present disclosure. For the advantages of the grayscale data compensation apparatus 400, the reference can be made to the above method embodiments, and it is not repeatedly described here.

Figure 6:
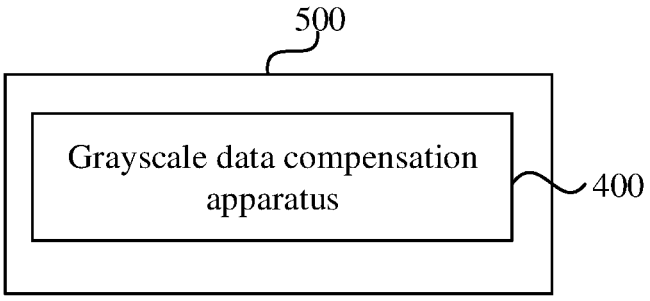
FIG. 6 is a structure diagram of a driver chip according to an embodiment.

The present embodiment further provides a driver chip. FIG. 6 is a structure diagram of a driver chip according to an embodiment. Referring to FIG. 6, a driver chip 500 includes a grayscale data compensation apparatus 400 provided in the above embodiment of the present disclosure. The storage medium 420 in the grayscale data compensation apparatus 400 is further configured to store the coefficient variation value and the reference compensation coefficient.

In an embodiment, the storage medium 420 is configured to store a correspondence lookup table between interval boundary instruction values and coefficient variation values.

In an embodiment, the storage medium 420 includes a flash memory.

Figure 7:
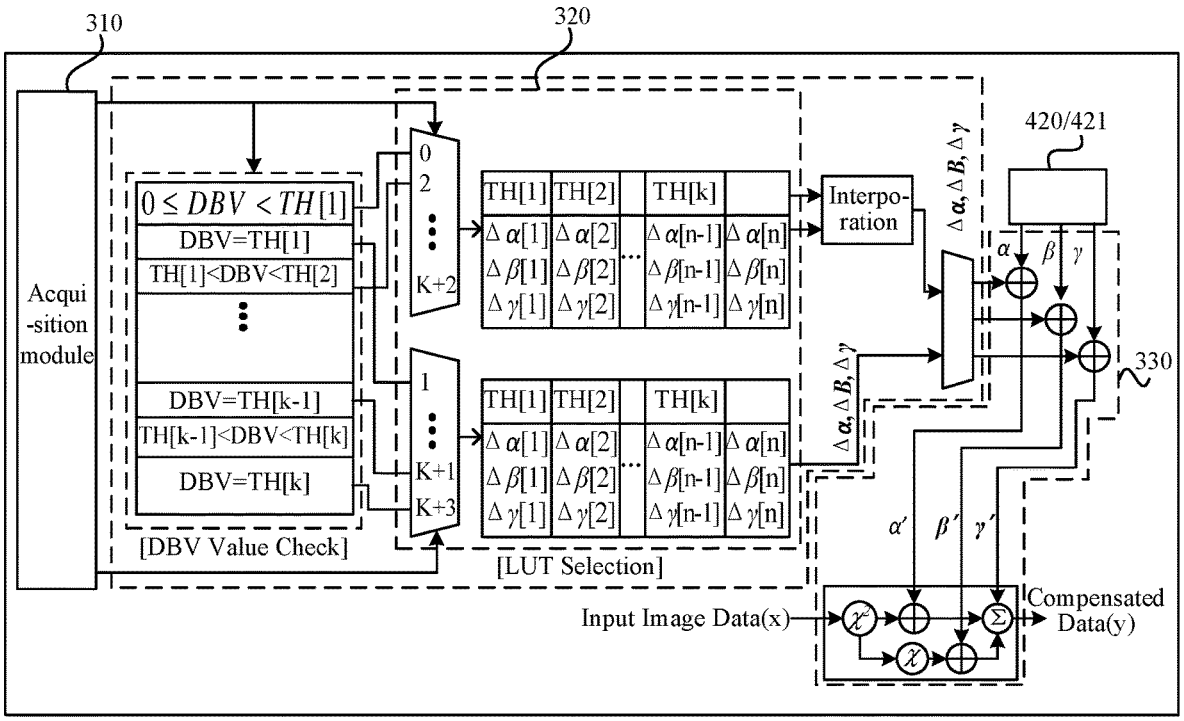
FIG. 7 is a schematic diagram illustrating that a grayscale data compensation method is performed by a grayscale data compensation apparatus in a driver chip according to an embodiment.

FIG. 7 is a schematic diagram illustrating that a grayscale data compensation method is performed by a grayscale data compensation apparatus in a driver chip according to an embodiment. Referring to FIG. 7, after an acquisition module 310 acquires a display brightness instruction value, a determination module 320 compares the display brightness instruction value with a display brightness boundary value. In [DBV Value Check] executed by the determination module 320 in FIG. 7, 0, TH[1], TH[2], . . . , TH[k−1] and TH[k] denote interval boundary instruction values. [LUT Selection] denotes a correspondence lookup table between the interval boundary instruction values 0, TH[1], TH[2], . . . , TH[k−1] and TH[k] and coefficient variation values. The correspondence lookup table may be stored in the first storage space of the storage medium 420. Moreover, an input display brightness instruction value and a range boundary instruction value are compared in [DBV Value Check] so that whether a coefficient variation value is calculated using an interpolation method or a coefficient variation value corresponding to the interval boundary instruction value is used as the coefficient variation value corresponding to the input display brightness instruction value is determined. An upper branch of the determination module 320 indicates that the input display brightness instruction value is not equal to the interval boundary instruction value. In this case, the coefficient variation value is calculated by the interpolation method. Interpolation in FIG. 7 indicates that the coefficient variation value is calculated by the interpolation method. In FIG. 7, a lower branch indicates that the input display brightness instruction value is equal to the interval boundary instruction value. In this case, the coefficient variation value corresponding to the interval boundary instruction value is directly used as the coefficient variation value corresponding to the display brightness instruction value. A compensation module 330 compensates for grayscale data according to the reference compensation coefficient stored in the second storage space 421 of the storage medium 420 (for example, the second storage space 421 may be a flash memory) and the coefficient variation value. For example, grayscale data before demura is x (corresponding to Input Image Data (x) in FIG. 7) and grayscale data after demura is y (corresponding to Compensated Image Data (y) in FIG. 7), where it is assumed that y is a quadratic function of x. Reference compensation parameters corresponding to a standard brightness instruction value are $\alpha$, $\beta$ and $\gamma$ and the coefficient variation value is $\Delta\alpha$, $\Delta\beta$ and $\Delta\gamma$. When the coefficient variation value represents a differential between a target grayscale compensation coefficient corresponding to the input display brightness instruction value and the reference compensation coefficient under the standard brightness instruction value, the relationship between y and x may be expressed as: $y=(\alpha+\Delta\alpha)x^2+(\beta+\Delta\beta)x+(\gamma+\Delta\gamma)$, where $\alpha+\Delta\alpha$, $\beta+\Delta\beta$ and $\gamma+\Delta\gamma$ may correspond to $\alpha'$, $\beta'$ and $\gamma'$ in FIG. 7, respectively.

The driver chip provided in the present embodiment includes the grayscale data compensation apparatus provided in any one of the preceding embodiments. The input display brightness instruction value is acquired by the acquisition module; the coefficient variation value corresponding to the input display brightness instruction value is determined by the determination module according to a relationship in magnitude between the input display brightness instruction value and the interval boundary instruction value corresponding to a range boundary; and the grayscale data is compensated by the compensation module according to the coefficient variation value and the reference compensation coefficient pre-stored under the standard brightness instruction value. An effect of a brightness level (corresponding to the display brightness instruction value) on a mura compensation effect is taken into account so that different brightness levels can correspond to grayscale compensation coefficients which are not exactly the same, that is, a grayscale compensation coefficient obtained finally corresponds to the brightness level (the display brightness instruction value), improving the mura compensation effect and display uniformity.

What is claimed is:

1. A grayscale data compensation method, comprising:

acquiring an input display brightness instruction value, wherein at least two ranges having an interval boundary therebetween are provided between a minimum display brightness instruction value and a maximum display brightness instruction value;

determining a coefficient variation value corresponding to the input display brightness instruction value according to a relationship in magnitude between the input display brightness instruction value and an interval boundary instruction value corresponding to the interval boundary, wherein the coefficient variation value is a difference value between a target grayscale compensation coefficient corresponding to the input display brightness instruction value and a reference compensation coefficient under a standard brightness instruction value, wherein the standard brightness instruction value is predetermined; and compensating grayscale data according to the coefficient variation value and the reference compensation coefficient pre-stored under the standard brightness instruction value.

2. The grayscale data compensation method according to claim 1, wherein determining the coefficient variation value corresponding to the input display brightness instruction value according to the relationship in magnitude between the input display brightness instruction value and the interval boundary instruction value corresponding to the interval boundary comprises:

comparing the input display brightness instruction value with the interval boundary instruction value, and when the input display brightness instruction value is equal to the interval boundary instruction value, determining a pre-stored coefficient variation value corresponding to the interval boundary instruction value to be the coefficient variation value corresponding to the input display brightness instruction value.

3. The grayscale data compensation method according to claim 2, wherein determining the coefficient variation value corresponding to the input display brightness instruction value according to the relationship in magnitude between the input display brightness instruction value and the interval boundary instruction value corresponding to the interval boundary further comprises:

when the input display brightness instruction value is greater than a first interval boundary instruction value and less than a second interval boundary instruction value, calculating the coefficient variation value corresponding to the input display brightness instruction value using an interpolation method according to a pre-stored coefficient variation value corresponding to the first interval boundary instruction value and a pre-stored coefficient variation value corresponding to the second interval boundary instruction value;

wherein the first interval boundary instruction value and the second interval boundary instruction value are two interval boundary instruction values of a same interval, respectively.

4. The grayscale data compensation method according to claim 3, wherein when the input display brightness instruction value is greater than the first interval boundary instruction value and less than the second interval boundary instruction value, calculating the coefficient variation value corresponding to the input display brightness instruction value by the interpolation method according to the pre-stored coefficient variation value corresponding to the first interval boundary instruction value and the pre-stored coefficient variation value corresponding to the second interval boundary instruction value comprises:

in the case where the input display brightness instruction value is greater than the first interval boundary instruction value and less than the second interval boundary instruction value, calculating the coefficient variation value corresponding to the input display brightness instruction value by the following formula:

$$Coefficientx = \text{Coefficient}\ [n-1] * (\text{Now}\ DBV - TH[k]) / (TH[k-1] - TH[k]) + \text{Coefficient}\ [n] * (\text{Now}\ DBV - TH[k-1]) / (TH[k] - TH[k-1]);$$

wherein Coefficientx denotes the coefficient variation value corresponding to the input display brightness instruction value, Coefficient[n−1] denotes the coefficient variation value corresponding to the first interval boundary instruction value, Coefficient[n] denotes the coefficient variation value corresponding to the second interval boundary instruction value, Now DBV denotes the input display brightness instruction value, TH[k−1] denotes the first interval boundary instruction value, and TH[k] denotes the second interval boundary instruction value.

5. The grayscale data compensation method according to claim 1, before acquiring the input display brightness instruction value, further comprising:

acquiring and storing a coefficient variation value corresponding to the interval boundary instruction value in advance.

6. The grayscale data compensation method according to claim 1, wherein the interval boundary instruction value corresponding to the interval boundary comprises the standard brightness instruction value.

7. The grayscale data compensation method according to claim 1, wherein different grayscales corresponding to a same display brightness instruction value correspond to a same coefficient variation value.

8. The grayscale data compensation method according to claim 1, wherein each display brightness instruction value corresponds to respective display brightness of a maximum grayscale in a display panel, and display brightness corresponding to another grayscale changes with the display brightness corresponding to the maximum grayscale in the display panel.

9. The grayscale data compensation method according to claim 8, wherein in a case where the display brightness corresponding to the maximum grayscale in the display panel increases, the display brightness corresponding to another grayscale increases, and in a case where the display brightness corresponding to the maximum grayscale in the display panel decreases, the display brightness corresponding to another grayscale decreases.

10. The grayscale data compensation method according to claim 9, wherein each input display brightness instruction value corresponds to one brightness level of the display panel.

11. The grayscale data compensation method according to claim 9, wherein the minimum display brightness instruction value comprises a display brightness instruction value corresponding to minimum display brightness of the maximum grayscale, and the maximum display brightness instruction value comprises a display brightness instruction value corresponding to maximum display brightness of the maximum grayscale.

12. The grayscale data compensation method according to claim 3, wherein the interpolation method comprises a linear interpolation method and a polynomial interpolation method.

13. The grayscale data compensation method according to claim 5, wherein acquiring and storing the coefficient variation value corresponding to the interval boundary instruction value in advance comprises:

acquiring grayscale compensation coefficients under a plurality of interval boundary instruction values by an optical compensation device, obtaining, according to grayscale compensation coefficients under a plurality of display brightness instruction values and a reference compensation coefficient under standard brightness, difference values between the grayscale compensation coefficients under the plurality of display brightness instruction values and the reference compensation coefficient under the standard brightness, and storing the difference values, wherein the difference values are in a one-to-one correspondence with the plurality of interval boundary instruction values and the difference values corresponding to the plurality of display brightness instruction values are coefficient variation values corresponding to the plurality of interval boundary instruction values.

14. The grayscale data compensation method according to claim 1, wherein when n ranges having via (n−1) range boundaries therebetween are provided between the minimum display brightness instruction value and the maximum display brightness instruction value, (n−1) sets of coefficient variation values are stored, wherein $n \geq 2$.

* * * * *